US007942185B2

(12) United States Patent
Long

(10) Patent No.: US 7,942,185 B2
(45) Date of Patent: May 17, 2011

(54) FOLDING LEAF GATE

(75) Inventor: Roger George Long, Salsfords (GB)

(73) Assignee: Cova Security Gates Limited

( * ) Notice: Subject to any disclaimer, the term of this patent is extended or adjusted under 35 U.S.C. 154(b) by 0 days.

(21) Appl. No.: 12/203,610

(22) Filed: Sep. 3, 2008

(65) Prior Publication Data

US 2009/0000197 A1 Jan. 1, 2009

(51) Int. Cl.
*E05D 15/26* (2006.01)

(52) U.S. Cl. ..... 160/213; 49/345; 49/340; 49/339; 160/210; 160/188

(58) Field of Classification Search ..... 49/324, 49/333, 334, 335, 340, 339, 336, 346, 341, 49/345; 160/210, 188, 199, 206, 207, 213
See application file for complete search history.

(56) References Cited

U.S. PATENT DOCUMENTS

| | | | | |
|---|---|---|---|---|
| 1,440,463 | A * | 1/1923 | Heaslip | 49/300 |
| 3,733,758 | A | 5/1973 | Maier et al. | |
| 4,148,163 | A | 4/1979 | Chenin et al. | |
| 4,233,938 | A * | 11/1980 | Ruetenik | 119/425 |
| 4,367,610 | A * | 1/1983 | Goode | 49/336 |
| 4,501,090 | A * | 2/1985 | Yoshida et al. | 49/264 |
| 5,623,784 | A * | 4/1997 | Kuersten et al. | 49/342 |
| 6,481,160 | B1 * | 11/2002 | Kowalczyk | 49/335 |
| 6,742,303 | B2 * | 6/2004 | Pedemonte | 49/339 |

FOREIGN PATENT DOCUMENTS

| | | |
|---|---|---|
| DE | 1 814 224 | 6/1970 |
| EP | 0 574 108 | 12/1993 |
| GB | 213650 | 3/1924 |
| GB | 1 453 037 | 10/1976 |
| WO | WO-01/11173 | 2/2001 |

* cited by examiner

*Primary Examiner* — Katherine Mitchell
*Assistant Examiner* — Catherine A Kelly
(74) *Attorney, Agent, or Firm* — Blank Rome LLP

(57) ABSTRACT

A folding leaf gate comprising a post hung section hingedly attachable to a gate post and at least one leaf hung section hingedly connected in series with the post hung section by means of one or more section hinges, wherein the folding leaf gate additionally includes a rotating device associated with the or each leaf hung section and sharing a common axis of rotation with the or each section hinge and secured in a static relationship to a leaf hung section whereby rotation of the or each rotating device causes rotation of a leaf hung section about the or each section hinge, and one or more translating devices engaging the or each rotating devices, the one or more translating device being configured, when in use, to translate rotational motion of the post hung section about a gate post to rotation of the one or more rotating devices whereby simultaneously to open a gateway closed by the folding leaf gate and fold the folding leaf gate in two or more.

16 Claims, 11 Drawing Sheets

OPENING AT POSITION OF MAX VELOCITY

CLOSED

OPENING AT POSITION OF MAX VELOCITY

FOLDING LEAF GATE

The invention relates to a folding leaf gate and in particular to a trackless folding leaf gate.

A folding leaf gate comprises a single leaf including two or more sections, normally of approximately equal length, each joined to an adjacent section by a hinged joint thereby allowing the leaf to be folded.

In the simplest arrangements, there are two sections. A post hung section is hinged directly to a gate post allowing it to swing through approximately 90° between an open position, when the gateway is open, and a closed position when the gateway is closed. Opening and closing of the gate may be automated, for example by a pneumatic, hydraulic or electromechanical means which can be controlled to move the post hung section between its open and closed positions.

The other section of a two section gate, known as the leaf hung section, includes a guide wheel mounted on an edge of the gate extending perpendicularly from the axis of the gate post in a position at or near to the edge of the leaf hung section which, when the gate is in its closed position, is distal to the post hung section. The guide wheel is guided by a track located either in the ground or overhead spanning the gateway within an operator top-box.

The shape of the track is so chosen that when the gate hung section is swung about the gate post to open the gate, the track draws the distal edge of the leaf hung section closer to the gate post forcing the leaf to fold at the hinged joint. When the gateway is fully open, the leaf is folded in two with the post hung and leaf hung sections facing each other, when fully closed, the leaf is fully outstretched, the post hung and leaf hung sections each facing the same direction.

The bi-folding leaf gate of the prior art suffers from a number of disadvantages, for example installation of the track, either in the ground or within an operator top-box, can be time consuming. Installation of a ground track where the surface of the ground is uneven or slopes requires considerable ground preparation. Furthermore installation of an overhead track requires the track to be higher than the tallest vehicle likely to use the gateway adding excessive and unnecessary structure to the gate.

SUMMARY OF THE INVENTION

The invention addresses the aforementioned problems by providing a folding leaf gate comprising a post hung section hingedly attachable to a gate post and at least one leaf hung section hingedly connected in series with the post hung section by means of one or more section hinges, wherein the folding leaf gate additionally includes a rotating device associated with the or each leaf hung section and sharing a common axis of rotation with a section hinge and secured in a static relationship to a leaf hung section whereby rotation of the or each rotating device causes rotation of a leaf hung section about the or each section hinge, and one or more translating devices engaging the or each rotating devices, the one or more translating device being configured, when in use, to translate rotational motion of the post hung section about a gate post to rotation of the one or more rotating devices whereby simultaneously to open a gateway closed by the folding leaf gate and fold the folding leaf gate in two or more.

A particular advantage of the folding leaf gate of the invention is that it does not require a track and hence avoids the need for the civil works attendant in installing a ground track or the additional engineering in providing an overhead track of height in excess of the tallest vehicle likely to use the gateway.

When the or each rotating device is associated with the leaf hung 4 section adjacent the post hung section, the or each rotating device may be a pinion and the or each translating device may comprise a rack engaging the pinion, translational motion of the rack causing rotation of the pinion. A particular advantage of this mechanism of folding the leaf is that it has a low profile and any protective casing is less intrusive.

Optionally the folding leaf gate may additionally include a retaining device for retaining the rack in engagement with the pinion, the retaining device comprising at least one cam roller surface whereby, in use, the cam roller surface provides a surface against which the rack may slide whilst being retained in engagement with the pinion.

The or each translating device may additionally include a rod, which, in use, is secured at a first rod end to the rack and at a second rod end to a gate post via a rod end bearing, the rack being in alignment with the longitudinal axis of the rod, the rod forming an acute angle with a plane which includes a rear surface of the post hung section, the apex of the acute angle lying at the intersection of the rack with the pinion, whereby, in use, as the rod and post hung section rotate about a gate post, the first rod end moves translationally with respect to the apex whereby to rotate the pinion and associated leaf hung section and to fold the folding leaf gate in two. The term rear surface of the post hung section is defined in the detailed description of the invention.

The folding leaf gate may include at least one rotating device which comprises a leaf hung sprocket or toothed gear wheel and at least one translating device comprising an endless chain or belt engaging the sprocket or wheel such that translational motion of the chain or belt causes rotation of the sprocket or wheel. A particular advantage of this mechanism for folding the leaf is that it can be easily adapted to fold a leaf gate of more than two sections.

When the or each leaf hung sprocket or wheel is associated with the leaf hung section adjacent the post hung section, the translating device may additionally include a gate post sprocket or gate post toothed gear wheel whose measured circumference is greater than that of the leaf hung sprocket or wheel and which is, in use, secured to a gate post in static relationship thereto, the gate post sprocket or wheel sharing a common axis of rotation with the or each section hinge associated with the gate post, the chain or belt engaging the leaf hung sprocket or wheel and the gate post sprocket or wheel whereby, in use, rotation of the post hung section about a gate post rotates the chain or belt about the gate post sprocket or wheel thereby to rotate the leaf hung sprocket or wheel and counter-rotate the leaf hung section adjacent the post hung section about the or each section hinge to fold the gate in two. Desirably the gate post sprocket or gate post toothed gear wheel has a measured circumference twice that of the leaf hung sprocket or wheel.

A or any first leaf hung section twice or more removed from the post hung section may be paired with a trailing sprocket or toothed gear wheel, each trailing sprocket or wheel being secured in a static relationship to a preceding twice removed any section and being coaxial with a second leaf hung sprocket or wheel associated with a second section sited one position closer to the post hung section, endless chains or belts engaging the said a or any first leaf hung sprocket or wheel and trailing sprocket or wheel whereby, in use, when each second section rotates about a section hinge coaxial with each second leaf hung sprocket or wheel, the endless chain or belt is caused to rotate about each trailing sprocket or wheel thereby to rotate the or any first leaf hung sprocket or wheel and to counter-rotate the or any first leaf hung section about a section hinge coaxial with the or any first leaf hung sprocket or wheel and to fold the gate.

Desirably the or any first leaf hung sprocket or wheel has a measured circumference identical to that of the trailing sprocket or toothed gear wheel.

The term preceding twice removed any section means a section having one other section disposed (in series) between a reference section and the said section, the said section lying between the reference section and gate post. The term leaf hung section twice or more removed from the post hung section means a leaf hung section having one or more other leaf hung sections disposed in series between the said leaf hung section and the post hung section.

The endless chain may be simplex (one chain), duplex (two chains arranged in parallel with pins joining links of the first chain with corresponding links of the second chain) or triplex (three chains arranged in parallel with pins joining links of the first chain with corresponding links of the second and third chain). Both duplex and triplex chains are less susceptible to sagging than single chains and are hence more reliable.

The folding leaf gate may include at least one rotating device comprising a leaf hung bevel gear and at least one translating device comprising a shaft including a shaft bevel gear engaging the leaf hung bevel gear at a right angle such that rotational motion of the shaft about its longitudinal axis causes rotation of the leaf hung bevel gear.

The translating device may additionally include a gate post bevel gear whose measured circumference is greater than that of the leaf hung bevel gear and which is, in use, secured to a gate post in static relationship thereto when the or each leaf hung bevel gear is associated with the leaf hung section adjacent the post hung section, the gate post bevel gear sharing a common axis of rotation with a section hinge associated with the gate post, the shaft comprising an additional shaft bevel gear, the shaft bevel gear engaging the leaf hung bevel gear at a right angle and the additional shaft bevel gear engaging the gate post bevel gear at a right angle whereby, in use, rotation of the post hung section about a gate post rotates the additional shaft bevel gear thereby to rotate the shaft about its longitudinal axis and rotate the leaf hung bevel gear and counter-rotate the leaf hung section adjacent the post hung section about the section hinge to fold the gate in two. Desirably the gate post bevel gear has a measured circumference twice that of the leaf hung bevel gear.

A or any first leaf hung bevel gear associated with a or any first leaf hung section twice or more removed from the post hung section may be paired with a trailing bevel gear, each trailing bevel gear being secured in a static relationship to a preceding twice removed any section and being coaxial with a second leaf hung bevel gear associated with a second section sited one position closer to the post hung section, shafts comprising a shaft bevel gear and an additional shaft bevel gear, the shaft bevel gear engaging the said a or any first leaf hung bevel gear and the additional shaft bevel gear engaging the trailing bevel gear whereby, in use, when each second section rotates about a section hinge coaxial with each second leaf hung bevel gear, the shaft is caused to rotate about its longitudinal axis thereby to rotate the or any first leaf hung bevel gear and to counter-rotate the or any first leaf hung section about a section hinge coaxial with the or any first leaf hung bevel gear and to fold the gate.

A folding leaf gate may additionally include a guide wheel mounted on an edge of the gate extending perpendicularly from a longitudinal axis of the gate post in a position at or near to the edge of the leaf hung section which, when the gate is in its closed position, is distal to the post hung section, which guide wheel, in use, is self locatable in a ground plate guide when the gate is in its closed position. When located in the ground plate guide, the guide wheel provides additional rigidity to the gate.

A folding leaf gate may additionally include an actuator for powering the rotation of the post hung section about a gate post. The actuator may be selected from for example a manual, a pneumatic actuator, an electric actuator, an electromechanical and a hydraulic actuator.

In one embodiment, the actuator comprises a rotary drive motor (for example a torque motor) linked with the post hung section by a two part linkage mechanism comprising first and second parts pivotally connected together by a 360° pivot. The first part of the linkage mechanism has a first end fixedly connected to the drive of the motor and rotatable therewith, and a second end which is pivotally connected to a first end of the second part of the linkage mechanism. The second part of the linkage mechanism has a second end hingedly attached to the post hung section of the gate. The motor is positioned close to the point of rotation of the post hung section about the gate post and is desirably mounted on the gate post.

When the drive motor rotates, the first part of the linkage mechanism is rotated through of the order of 240° to 300° (for example about 270°) this rotational movement results in pivoting of the second part with respect to the first part of the linkage mechanism and opening of the hinge attachment between the post hung section and the second part of the linkage mechanism. The net effect is a shortening of the distance between the post hung section and the centre of rotation of the motor and drawing of the leaf hung section though a 90° rotation to open the gate. It will be appreciated that by means of the pivotal link between the two parts of the linkage mechanism, a 270° rotation of the drive motor is translated into a 90° rotation of the gate, providing a 3:1 mechanical advantage. The arrangement is thus both compact and efficient.

The high mechanical advantage provided by the proposed drive mechanism means that a lower powered motor can be used for a given size of gate. Thus the gate is opened more slowly and with less momentum, reducing the risk of accident to pedestrians or vehicles.

Preferably the folding leaf gate comprises an even number of sections because any guide wheel then subscribes a straight path across a gateway as the gate travels between its open and closed positions and the ground plate guide can be more easily located. Desirably the number of sections is four, more desirably two.

BRIEF DESCRIPTION OF THE FIGURES

The invention will now be exemplified with reference to:

FIG. 5 shows a plan view of the drive and gate with the gate in a closed configuration;

FIG. 6 shows a plan view of the drive and gate with the gate in a partially open configuration;

FIG. 7 shows a plan view of the drive and gate with the gate in a fully open configuration; and FIG. 8 shows a face on view of the drive mechanism when the gate is in a closed configuration.

DETAILED DESCRIPTION OF THE INVENTION

Figure 1:
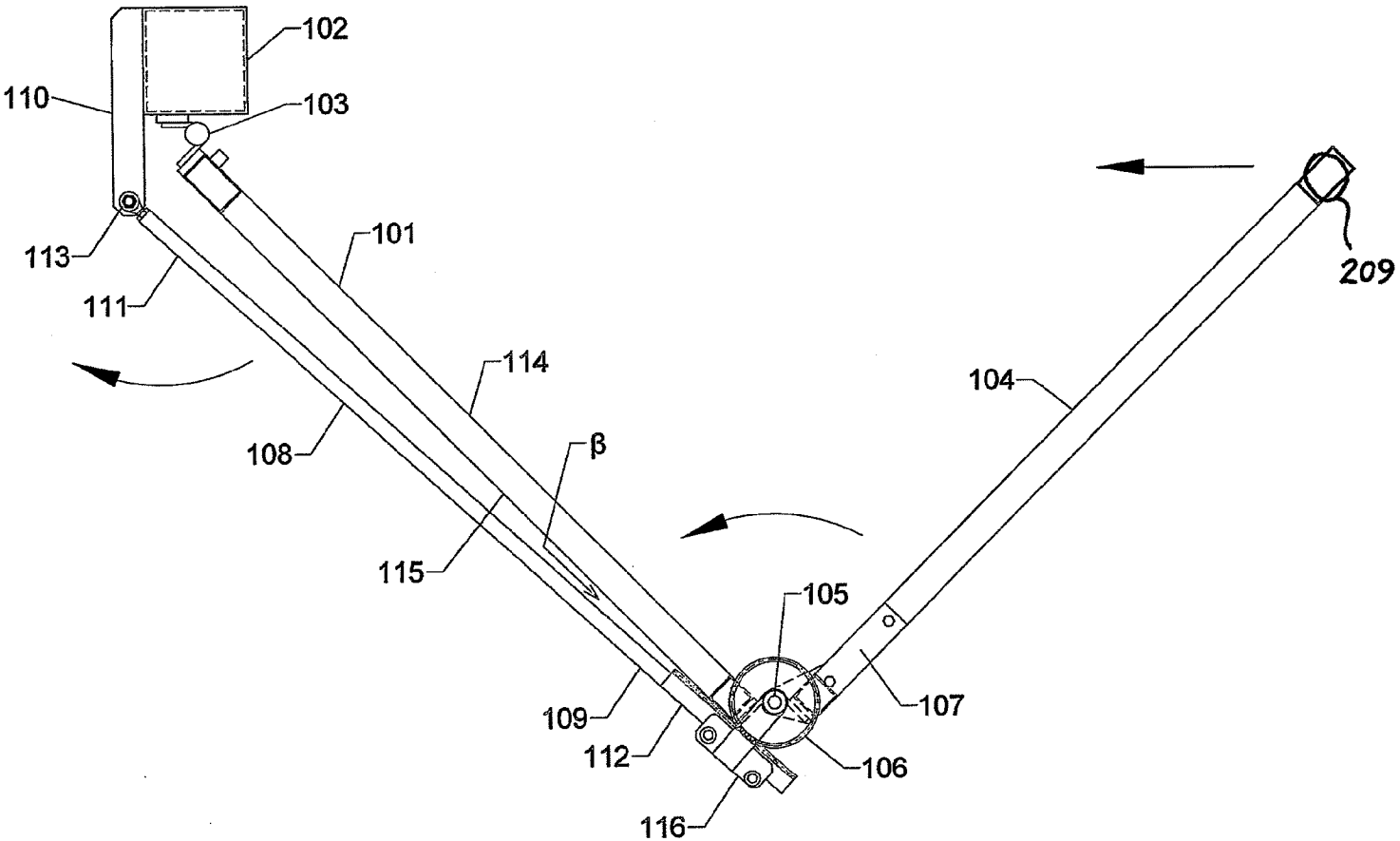
FIG. 1 which shows an overhead view of a bi-folding leaf gate in accordance with one embodiment of the invention.

In FIG. 1, a post hung section (101) of a bi-folding leaf gate is secured to a gate post (102) by a post hinge (103). A leaf hung section (104) is secured to the post hung section (101) by a section hinge (105). A pinion (106) is secured to the leaf hung section (104) proud of a top surface of the leaf hung section (107), its axis of rotation concentric with that of the section hinge (105), whereby the pinion (106) remains in static relationship to the leaf hung section (104) whereby rotation of the pinion (106) about its axis of rotation causes rotation of the leaf hung section (104) about the section hinge (105).

The post hung section (101) further comprises front (114) and rear (115) surfaces. A rod (108) forms an acute angle β with a plane including the rear surface (115). A first rod end (109) carries a rack (112), the rack (112) being in alignment with the longitudinal axis of the rod. The rack (112) engages the pinion (106) at the apex of acute angle β. A second rod end (111) is secured to a gate post arm (110) via a rod end bearing (113), the gate post arm (110) itself being secured to the gate post (102).

A retaining device (116) is formed around the rack (112) to assist engagement of the rack (112) with the pinion (106). The retaining device (116) comprises two cam roller surfaces (not shown) which provide, in use, a surface against which the rack (112) may slide whilst being retained in engagement with the pinion (106).

In use, an actuator (not shown) powers the post hung section (101) through a 90° swing. As the post hung section (101) moves to an open position, the rod (108) and rack (112) move with the post hung section (101), the rod pivoting about the rod end bearing (113). In conjunction with the pivoting motion of the rod, the rack (112) slides past the pinion (106), thereby to cause rotation of the pinion (106). Rotation of the pinion (106) causes rotation of the leaf hung section (104) about the section hinge (105) thereby folding the bi-folding leaf gate in two.

Figure 2A:
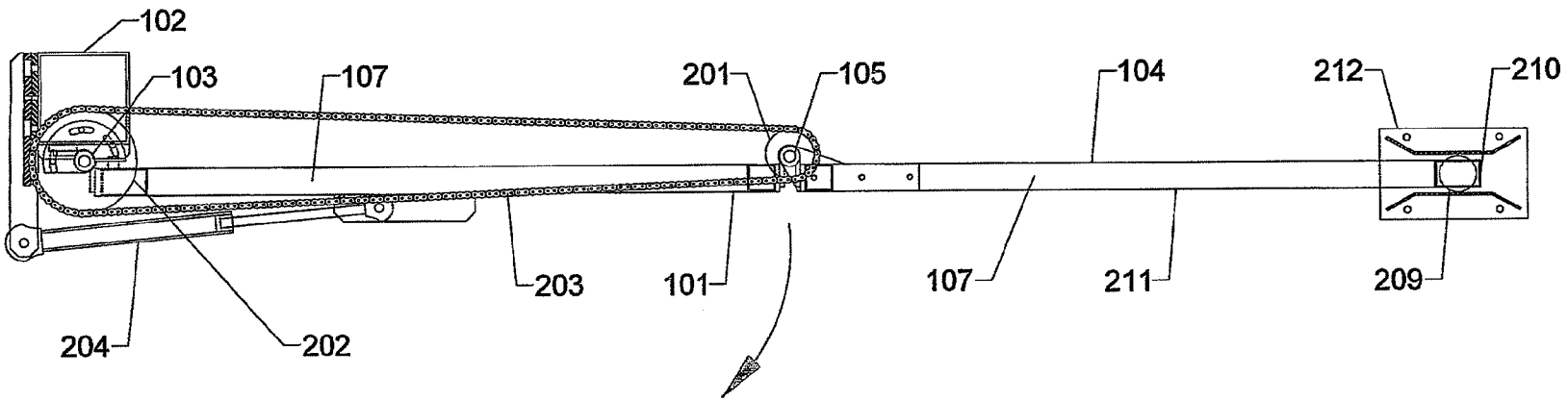
FIGS. 2*a*-2*c* which shows a sequence of overhead views of a bi-folding leaf gate in accordance with a second embodiment of the invention in the closed, opening and open positions.

In a second embodiment of the invention shown in FIG. 2*a*, the post hung section (101) of a bi-folding leaf gate is secured to the gate post (102) by the post hinge (103). The leaf hung section (104) is secured to the post hung section (101) by the section hinge (105). A leaf hung sprocket (201) is secured to the leaf hung section (104) proud of the top surface of the leaf hung section (107), its axis of rotation concentric with that of the section hinge (105), whereby the leaf hung sprocket (201) remains in static relationship to the leaf hung section (104) whereby rotation of the leaf hung sprocket (201) about its axis of rotation causes rotation of the leaf hung section (104) about the section hinge (105).

A gate post sprocket (202) is secured to the gate post (102) proud of the top surface of the leaf hung section (107), its axis of rotation concentric with the post hinge (103), whereby the gate post sprocket (202) remains in static relationship to the gate post (102) and neither rotating about its axis nor undergoing translational movement. The gate post sprocket (202) has a circumference which is twice that of the leaf hung sprocket (201).

An endless duplex chain (203) engages the leaf hung (201) and gate post (202) sprockets.

Included on the leaf hung section (104) is a guide wheel (209) mounted on an edge of the gate extending perpendicularly from a longitudinal axis of the gate post (211) in a position at or near to the edge of the leaf hung section which, when the gate is in its closed position, is distal to the post hung section (210). The guide wheel (209) locates itself in a ground plate guide (212) when the gate is in its closed position.

In use, a hydraulic actuator (204) powers the post hung section (101) through a 90° swing. Pivotal movement of the post hung section (101) about the post hinge (103) to an open position rotates the endless duplex chain (203) about the (stationary) gate post sprocket (202). Rotation of the endless duplex chain (203) about the gate post sprocket (202) inevitably drives the leaf hung sprocket (201) thereby causing the leaf hung section (104) to rotate about the section hinge (105).

Figure 2B:
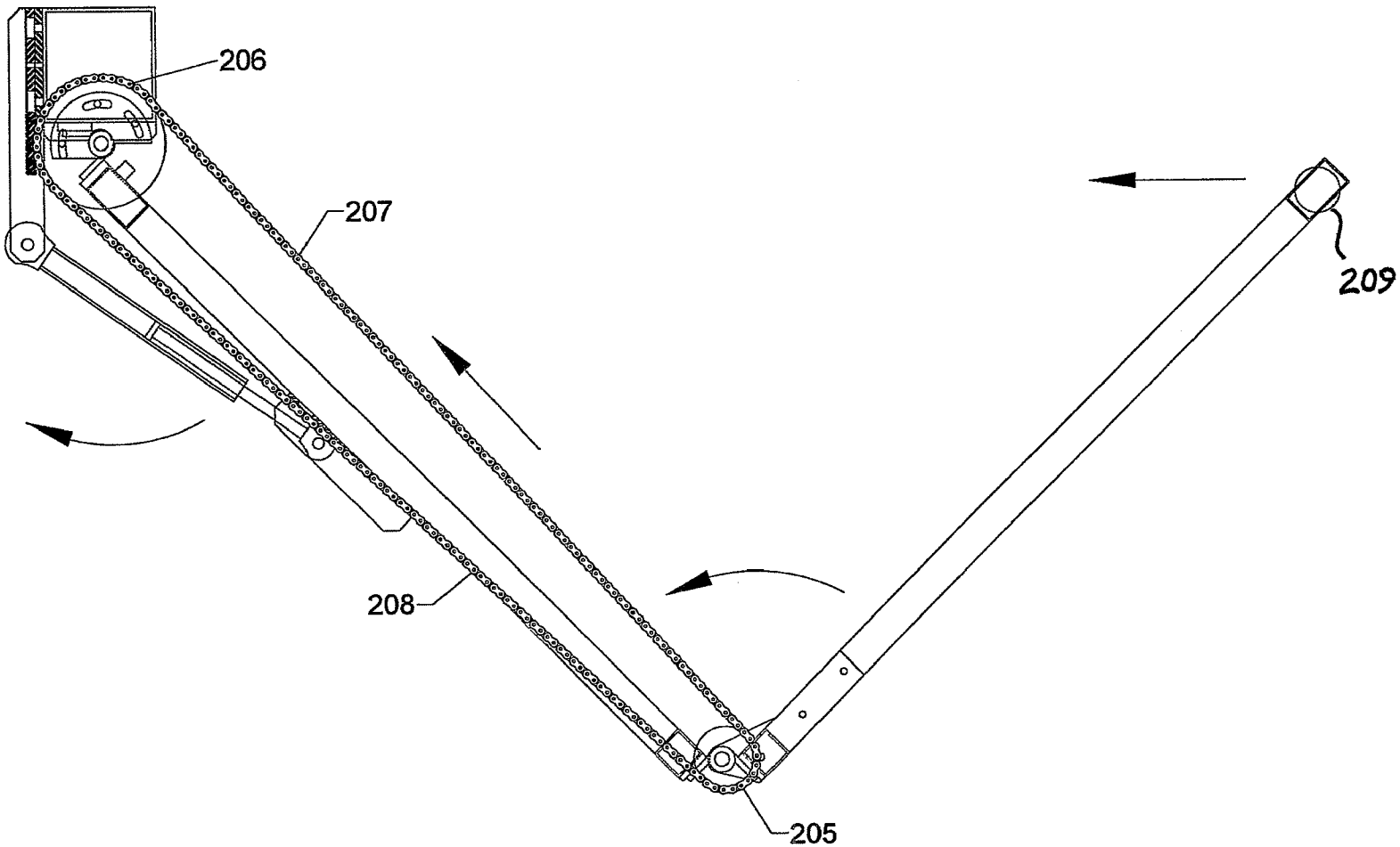
Figure 2C:
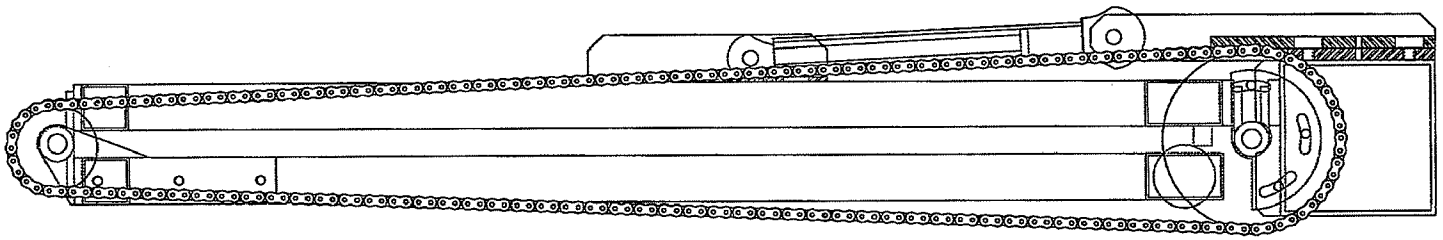

With reference to FIGS. 2*a*-2*c*, the endless duplex chain (203) rotates in an anti-clockwise direction as indicated by the arrow. This anti-clockwise rotation of the endless duplex chain (203) rotates the leaf hung sprocket (201) in an anti-clockwise direction thereby rotating the leaf hung section (104) in an anti-clockwise direction folding the bi-folding leaf gate in two as shown in FIG. 2*c*.

As the circumference of the gate post sprocket is twice that of the leaf hung sprocket, the number of chain links required to engage a quarter of the circumference of the gate post sprocket is identical to that required to engage half the circumference of the leaf hung sprocket. Thus, as the post hung section swings through 90°, the leaf hung section swings through 180°.

Figure 3A:
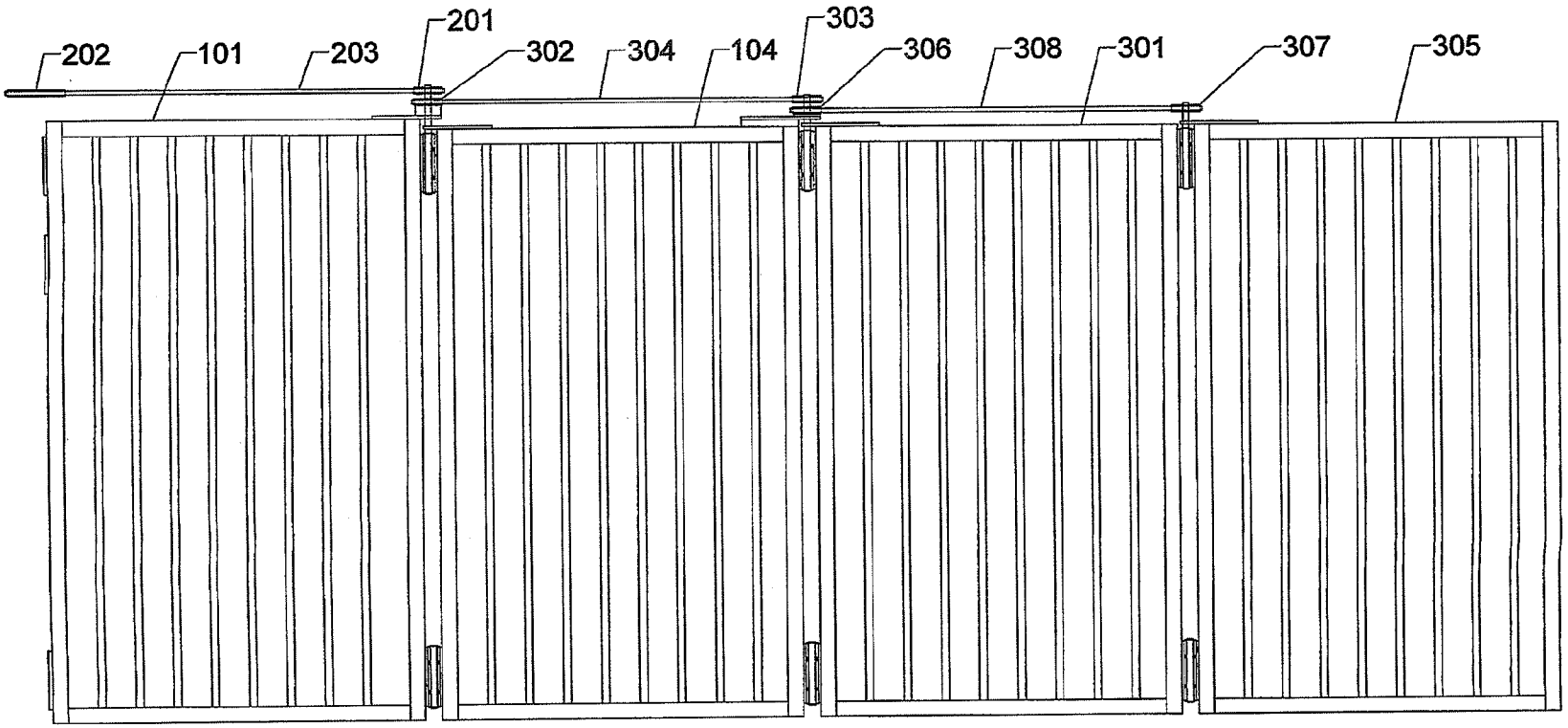
FIG. 3*a* which shows an elevation of a multi-folding leaf gate in accordance with a third embodiment of the invention in the closed position.

FIG. 3*a* shows the same principle of sprocket and chain applied to a four section leaf. The post hung (101) and leaf hung (104) sections operate in the same manner as described for a bi-folding leaf gate through the provision of the leaf hung (201) and gate post (202) sprockets secured in static relationship to the leaf hung section (104) and gate post (102) (not shown in FIG. 3*a*) respectively and neither rotating about their axes nor undergoing translational movement, and the endless duplex chain (203) which engages the leaf hung (201) and gate post (202) sprockets.

Rotation of a first additional leaf hung section (301) is achieved in a similar manner as for a bi-folding leaf gate through provision of a first trailing sprocket (302) secured in static relationship to the post hung section (101) and coaxial with the leaf hung sprocket (201) and neither rotating about its axis nor undergoing translational movement (effectively assuming the role of the gate post sprocket (202) in a bi-folding leaf gate), a first leading sprocket (303) secured in static relationship to the first additional leaf hung section (301) and neither rotating about its axis nor undergoing translational movement, and a first additional endless duplex chain (304) which engages the first trailing sprocket (302) and the first leading sprocket (303). The first trailing sprocket (302) has a circumference matching that of the first leading sprocket (303).

In use, as the post hung section (101) is rotated through 90°, the leaf hung section (104) swings through 180° as described for the bi-folding leaf gate. The 180° rotational movement of the leaf hung section (104) is transmitted to the first additional leaf hung section (301) in the same manner as the 90° rotational movement of the post hung section (101) is transmitted to the leaf hung section thereby to rotate the first additional leaf hung section (301) through 180° in a direction opposite to the direction of rotation of the leaf hung section (104).

Rotation of a second additional leaf hung section (305) is achieved in the same manner as described for the for first additional leaf hung section (301) through provision of a second trailing sprocket (306) secured in static relationship to the leaf hung section (104) and neither rotating about its axis nor undergoing translational movement (effectively assuming the role of the gate post sprocket (202) in a bi-folding leaf gate), a second leading sprocket (307) secured in static relationship to the second additional leaf hung section (305) and coaxial with the first leading sprocket (303) and neither rotating about its axis nor undergoing translational movement, and a second additional endless duplex chain (308) which engages the second trailing sprocket (306) and the second leading sprocket (307). The second trailing sprocket (306) has a circumference matching that of the second leading sprocket (307).

Figure 3B:
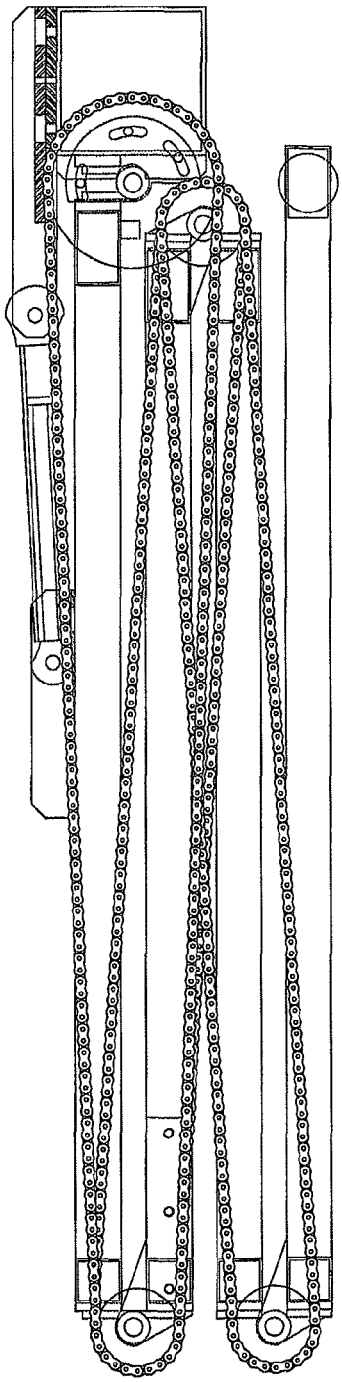
FIG. 3*b* which shows an overhead view of the multi-folding leaf gate in accordance with the third embodiment of the invention in the open position.

In use, as the post hung section (101) is rotated through 90°, the leaf hung section (104) swings through 180° as described for the bi-folding leaf gate. The 180° rotational movement of the leaf hung section (104) is transmitted to the first additional leaf hung section (301) in the same manner as the 90° rotational movement of the post hung section (101) is transmitted to the leaf hung section thereby to rotate the first additional leaf hung section (301) through 180° in a direction opposite to the direction of rotation of the leaf hung section (104). The 180° rotational movement of the first additional leaf hung section (301) is transmitted to the second additional leaf hung section (305) In a like manner thereby to rotate the second additional leaf hung section (305) through 180° in a direction opposite to the direction of rotation of the first additional leaf hung section (301) as illustrated in FIG. 3*b*.

Figure 4:
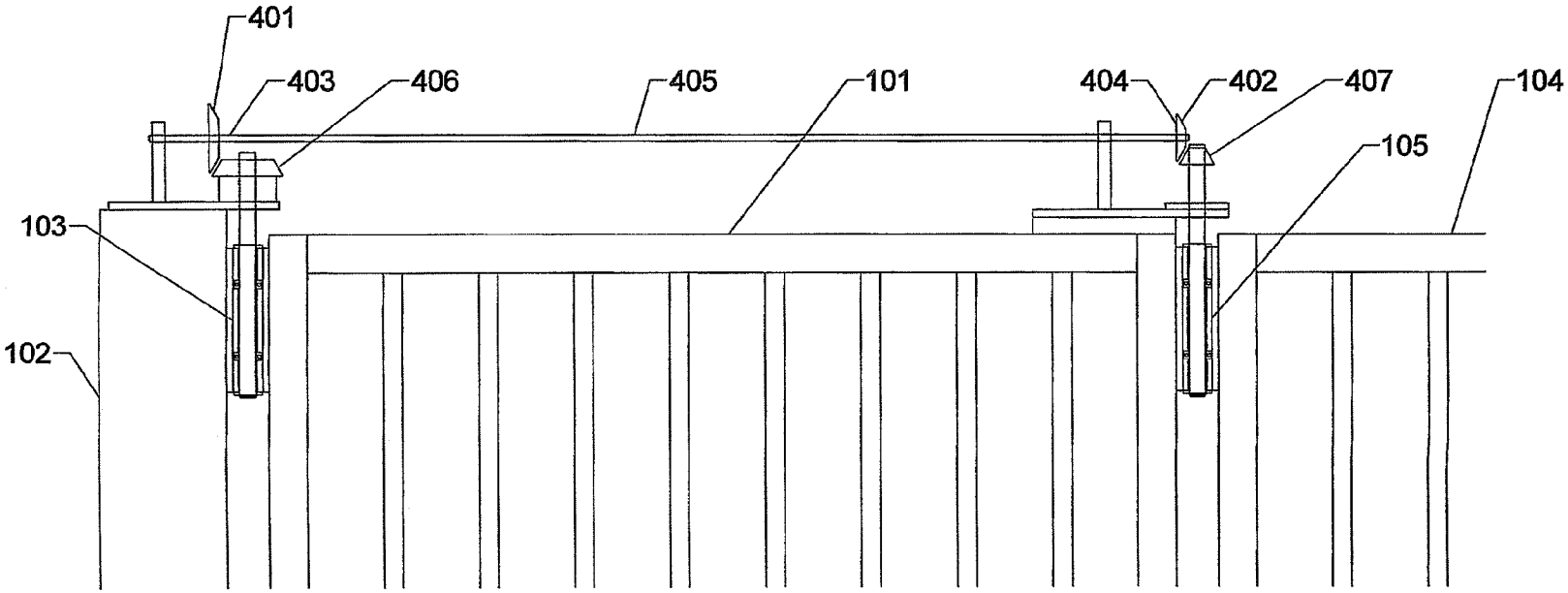
FIG. 4 which shows an elevation of a bi-folding leaf gate in accordance with a third embodiment of the invention.
Figure 5:
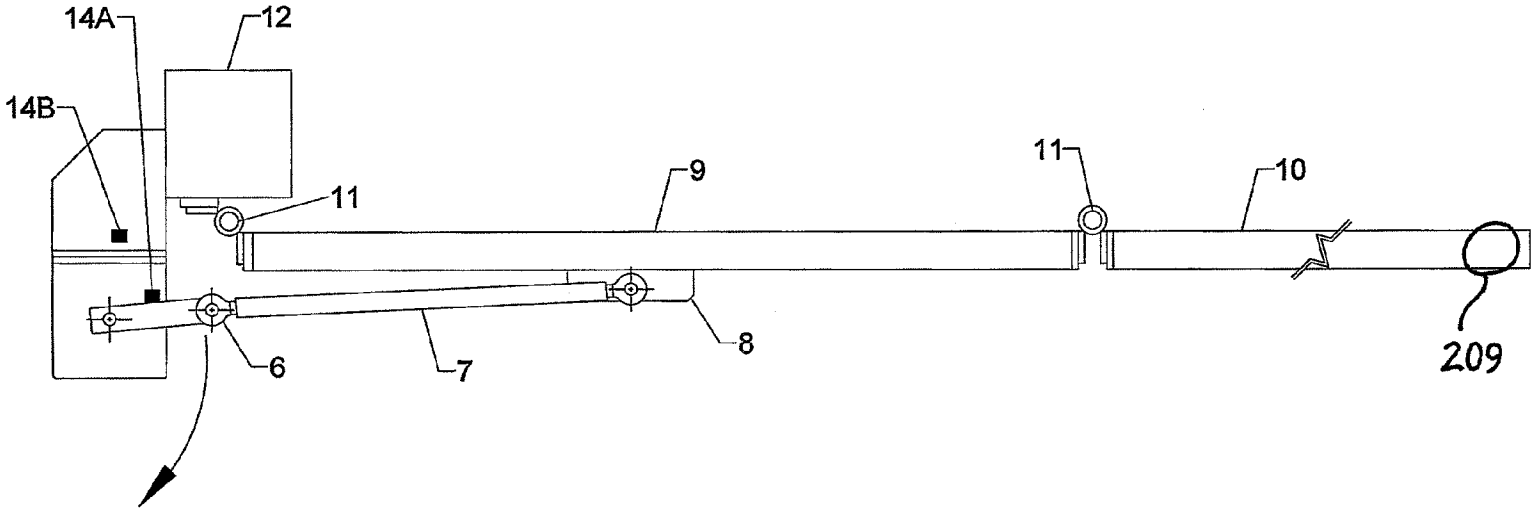
FIGS. 5-8 illustrate one embodiment of a drive mechanism which can be used to rotate the gate hung section about the post.
Figure 6:
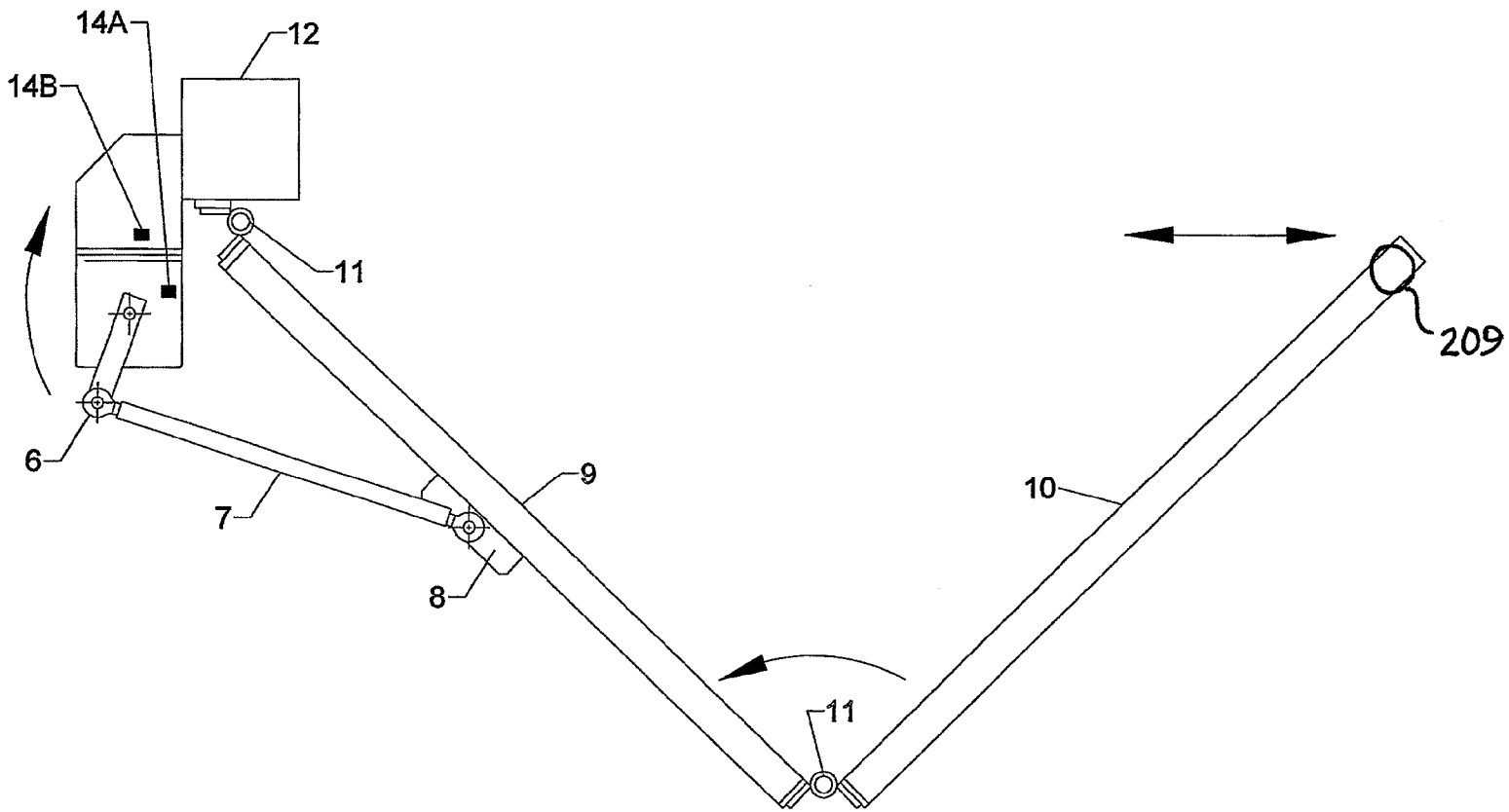

In a third embodiment shown in FIG. 4, a shaft (405) comprising first (401) and second (402) shaft bevel gears at first and second shaft ends (403, 404) respectively is used in place of a duplex chain (203). A gate post bevel gear (406) and a leaf hung bevel gear (407) are used in place of the gate post sprocket (202) and leaf hung sprocket (201). The first and second shaft bevel gears (401, 402) interact at right angles with the gate post bevel gear (406) and a leaf hung bevel gear (407) respectively. The shaft (405) is rotatable about the axis of rotation of the gate post bevel gear. The gate post bevel gear (406) has a circumference which is twice that of the leaf hung bevel gear (407).

In use, a hydraulic actuator powers the post hung section (101) through a 90° swing. Pivotal movement of the post hung section (101) about the post hinge (103) to an open position rotates the shaft (405) about the (stationary) gate post bevel gear (406) thereby rotating the shaft (405) about its longitudinal axis. Rotation of the shaft (405) about its longitudinal axis inevitably drives the leaf hung bevel gear (407) thereby causing the leaf hung section (104) to rotate about the section hinge (105).

The same principle of bevel gears and shaft is applied to a four section leaf (not shown) in the manner described hereinabove for the sprocket and chain combination.

FIGS. 5 to 8 illustrates a folding leaf gate comprising a post hung section 9 and leaf hung section 10, hinged together by hinge 11. The gate is connected to a gate post 12 via another hinge 11. Provided on the post hung section 9 is a mount 8 to which is pivotally connected a first part 7 of a two part linkage mechanism comprising crank 4, spacer 5, rod end bearing (pivot) 6 and rod 7. At an opposing end of the first part (rod) 7 is a 360° pivot 6 and spacer 5 linking the first part 7 with a second part (the crank) 4 which is in turn attached to the rotor of drive motor 1 via shaft 3.

An electromagnetic brake 2 is sited around the shaft 3 at the top of the drive motor 1. A pair of stops 14*a*, 14*b* limit the rotational movement of the crank 4 about the drive 1.

As can be seen from the FIGS. 5 to 8, when the gate is closed, the motor drives against a first rubber stop 14*a* which is positioned closer to the post 12 than the centre of rotation of the motor. When the drive hits the stop 14*a*, it can be seen that the gate 9,10 sits in the closed position, with both sections 9,10 in alignment. The crank 4 is directed toward the post hung section 9 and the two parts of the linkage mechanism 4, 7 are also substantially in alignment. Desirably, the pivot 6 is slightly broken towards the gate 9,10. The electromagnetic brake 2 engages to maintain the position of the rotary drive 1 and the crank 4. In this position, the gate cannot easily be forced open by application of force to the entrance face of the gate (i.e. the face opposing the face to which the linkage mechanism is connected).

To open the gate, the brake 2 is disengaged and the direction of rotation of the drive motor 1 is reversed. The crank 4 travels around the motor 1. As the crank 4 moves, it unlocks the pivot 6 and pulls the rod 7 which in turn pulls on the post hung section 9 of the gate. As the crank 4 continues to travel, the crank 4 and rod 7 start to overlap folding the linkage mechanism into two, with the pivot 6 being pulled increasingly greater distances from the post hung section 9. The drive stops when it encounters the second rubber stop 14*b*. Again the brake 2 can be engaged to hold the position of the crank 4 and hence the gate.

It will be appreciated that the motor 1 is positioned relatively close to the hinge 11 about which the post hung section 9 of the gate rotates. This results in a very small angle between the gate 9, 10 and linkage mechanism 4,5,6,7 when the gate is closed (for example 30° or less) and enables the drive to travel a large rotational angle (for example between about 240° and 300°) before the gate 9,10 collides with the motor 1. This large rotational angle provides the drive with a mechanical advantage of the order of 3:1, thus relatively low powered motors can be used. For example, a small gate may be driven by a 20 Nm torque motor giving a gate opening/closing time of around 4.5 seconds, a large gate may be driven by a 50 Nm torque motor giving an opening/closing time of around 6 seconds.

Figure 7:
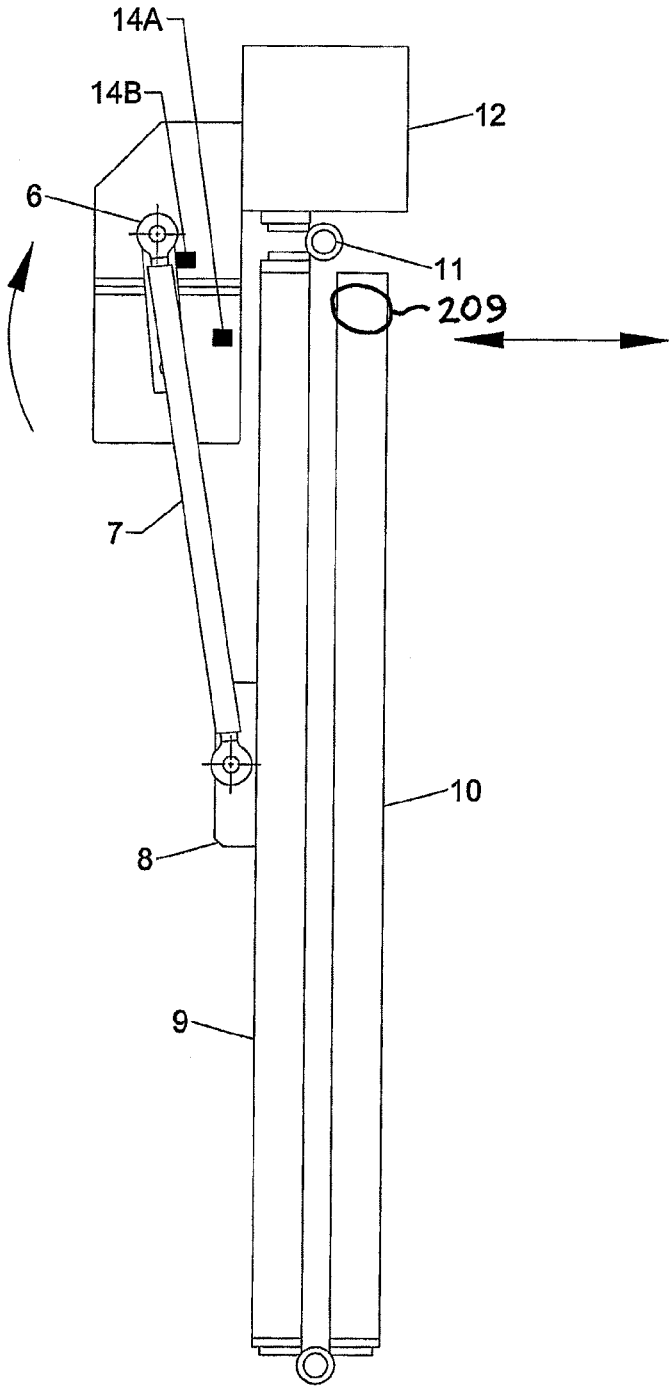
Figure 8:
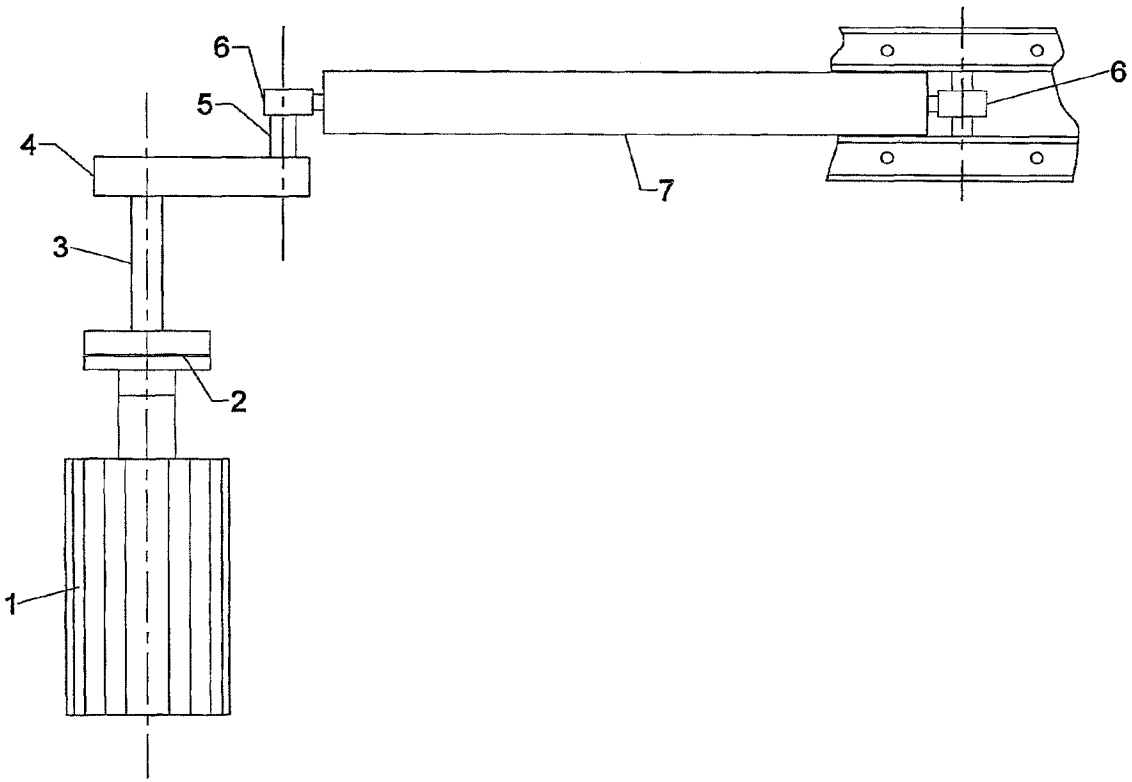

As can be seen in FIG. 7, when the gate is fully open, the crank 4 is directed towards the gate post 12. Stop 14*b* is again positioned just slightly closer to the gate 9,10 than is the centre of rotation of the motor so that the linkage mechanism 4,5,6,7 is locked against any force attempting to close the gate.

It will be appreciated that the configuration of the linkage mechanism 9,10 and its relationship with the drive 4, is such as to permit that the speed at which the gate opens follows a sinusoidal pattern. Thus, initial opening of the gate is relatively slow, the speed of the gate peaks when the crank 4 and rod 7 are at 90° to each other and then slows to a gentle stop as the crank 4 approaches the second stop position. This provides a useful safety feature providing early warning to persons in the vicinity of the gate that the gate is about to open and also reduces risk of damage to the gate as it swings to the fully open position by slowing down progressively.

It will be appreciated that the drive mechanism has application not only in relation to gates in accordance with the present invention, but also with swing open gates of other configurations, whether folding leaf gates or not.

The invention claimed is:

1. A folding leaf gate comprising a post hung section hingedly attachable to a gate post and one or more leaf hung sections hingedly attachable in series with the post hung section by means of one or more section hinges and an actuator for facilitating the opening and closing of the gate, the actuator comprising a rotary drive motor positioned close to the point of rotation of the post hung section about the gate post, characterised in that the actuator further includes a two part linkage mechanism comprising first and second parts, each part having first and second ends respectively, the first end of the first part being fixedly connected to the drive of the motor and rotatable therewith, and the second end of the first part being pivotally connected to a first end of the second part via a 360° pivot, the second end of the second part being hingedly attached to the post hung section of the gate, the linkage mechanism being configured such that upon rotation of the drive motor, the first part of the linkage mechanism is rotated through an angle of between 240° and 300° between first and second stop positions corresponding to the fully opened or fully closed position of the gate, the rotation causing pivotal movement of the second part of the linkage mechanism relative to said first part thereby to cause the gate sections to be rotated through 90°.

2. A folding leaf gate according to claim 1, wherein the two part linkage mechanism moves from a configuration in which the two parts are substantially aligned when the gate is in a closed position to a configuration in which the two parts substantially overlap when the gate is in an open position.

3. A folding leaf gate according to claim 1, wherein the rotary drive motor and linkage mechanism are configured such that when the gate is in the closed configuration, the linkage mechanism subtends an angle of 30° or less to the gate.

4. A folding leaf gate according to claim 1, wherein the rotary drive motor is mounted onto a surface of a gate post.

5. A folding leaf gate according to claim 1, in which the actuator is provided with a pair of rubber stops corresponding to the rotational positions of the first part when the gate is in a fully opened or fully closed position.

6. A folding leaf gate according to claim 5, wherein the stops are separated by an angle of between 240° and 300°.

7. A folding leaf gate according to claim 6, wherein the stops are separated by an angle of 270°.

8. A folding leaf gate according to claim 1, wherein the motor is provided with a brake for holding the rotational position of the motor when the gate is in a fully opened or fully closed configuration.

9. A folding leaf gate according to claim 8, wherein the brake is an electromagnetic brake.

10. A folding leaf gate according to claim 1, which further includes one or more rotating devices, each rotating device being associated with any one of the one or more leaf hung sections respectively, each rotating device sharing a common axis of rotation with the section hinge associated with the leaf hung section with which that rotating device is also associated, each rotating device being secured in static relationship to its respective leaf hung section whereby rotation of any of the one or more rotating devices causes rotation of its respective leaf hung section about its associated section hinge; the folding leaf gate further comprising one or more translating devices, each of the one or more translating devices being associated with one of the one or more leaf hung sections and its corresponding rotating device, the translating device being engagable at one end with its corresponding rotating device and anchored at its other end to a section once removed from the leaf hung section having the rotating device with which the translating device is associated or the gate post whereby in use the one or more translating devices translate the rotational movement of the post hung section about a gate post to rotation of the one or more rotating devices thereby to simultaneously to open a gateway closed by the folding leaf gate and to fold the folding leaf gate into two or more.

11. A folding leaf gate according to claim 10 wherein the leaf hung section is adjacent to the post hung section, the rotating device is a pinion and the translating device comprises a rack which rack engages the pinion such translational motion of the rack causes rotation of the pinion.

12. A folding leaf gate according to claim 11 additionally including a retaining device, for retaining the rack in engagement with the pinion, the retaining device comprising at least one cam roller surface whereby, in use, the cam roller surface provides a surface against which the rack may slide whilst being retained in engagement with the pinion.

13. A folding leaf gate according to claim 11 wherein the or each translating device additionally includes a rod, which, in use, is secured at a first rod end to the rack and at a second rod end to a gate post via a rod end bearing, the rack being in alignment with the longitudinal axis of the rod, the rod forming an acute angle with a plane which includes a rear surface of the post hung section, the apex of the acute angle lying at the intersection of the rack with the pinion, whereby, in use, as the rod and post hung section rotate about a gate post, the first rod end moves translationally with respect to the apex whereby to rotate the pinion and associated leaf hung section and to fold the folding leaf gate in two.

14. A folding leaf gate according to claim 1 additionally including a guide wheel mounted on an edge of the gate extending perpendicularly from a longitudinal axis of the gate post in a position at or near to the edge of the leaf hung section which guide wheel, when the gate is in its closed position, is distal to the post hung section, which, in use, is self locatable in a ground plate guide when the gate is in its closed position.

15. A folding leaf gate according to claim 1 wherein the leaf gate comprises an even number of sections.

16. A folding leaf gate according to claim 15 wherein the number of sections is two.

* * * * *